United States Patent [19]

Grzeskowiak

[11] Patent Number: 5,028,521

[45] Date of Patent: Jul. 2, 1991

[54] PROCESS FOR THE PREPARATION OF PHOTOGRAPHIC SILVER HALIDE EMULSIONS HAVING TUBULAR GRAINS

[75] Inventor: Nicholas E. Grzeskowiak, Harlow, Great Britain

[73] Assignee: Minnesota Mining and Manufacturing Company, St. Paul, Minn.

[21] Appl. No.: 481,176

[22] Filed: Feb. 20, 1990

[30] Foreign Application Priority Data

Apr. 3, 1989 [GB] United Kingdom ..... 8907442

[51] Int. Cl.[5] ..... G03C 1/005

[52] U.S. Cl. ..... 430/569; 430/567

[58] Field of Search ..... 430/569, 567

[56] References Cited

U.S. PATENT DOCUMENTS

| | | | |
|---|---|---|---|
| 4,433,048 | 2/1984 | Solberg et al. | 430/434 |
| 4,722,886 | 2/1988 | Nottorf | 430/569 |
| 4,801,522 | 1/1989 | Ellis | 430/569 |

*Primary Examiner*—Charles L. Bowers, Jr.
*Assistant Examiner*—Janis L. Dote
*Attorney, Agent, or Firm*—Gary L. Griswold; Walter N. Kirn; Mark A. Litman

[57] ABSTRACT

A process for the preparation of a photographic emulsion containing tabular silver halide grains having an aspect ratio in the range from 12:1 to 3:1 and a monomodal narrow size distribution comprising:

(i) preparing a dispersing medium/bromide mixture having a pBr in the range 0.7 to 1.0, (ii) adding to the mixture silver nitrate and further halide as necessary to maintain an excess of bromide whereby tabular seed grains are formed, (iii) adding ammoniacal base solution to the mixture to achieve at least 0.02N of the base aftr at least 20% by weight of the total silver nitrate has been added, (v) adding further silver nitrate and halide by balanced double jet procedure while maintaining a concentration of ammoniacal base of at least 0.02N, whereby tabular grains are formed.

10 Claims, 1 Drawing Sheet

PROCESS FOR THE PREPARATION OF PHOTOGRAPHIC SILVER HALIDE EMULSIONS HAVING TUBULAR GRAINS

FIELD OF THE INVENTION

This invention relates to the preparation of photographic emulsions and in particular to the preparation of silver halide emulsions having thick tabular grains.

BACKGROUND TO THE INVENTION

Tabular grains are crystals possessing two major faces that are substantially parallel in which the average diameter of said faces is at least three times (and often many more times) the distance separating them.

Silver bromide photographic emulsions containing a high proportion of crystals having a tabular or plate-like shape can readily be prepared according to Berry et al, Photographic Science and Engineering, 1961, Volume 4, Pages 332–333 in which a defined high excess of bromide ion, the concentration being specified as pBr 0.77 is present in the emulsification medium during the growth of the crystals, which is conducted by balanced double jet addition. This defines the basic conditions for satisfactory growth of this type of crystals. In common with other types of emulsion it is also useful to apply well know growth methods such as the use of a low initial rate of addition for the formation of the first small nuclei, increasing the rate of addition continuously or stepwise to a higher rate, as the crystals grow in diameter.

The tabular crystals in emulsions made by the above method, or modifications thereof having different addition rate procedures, additions of iodide, or slightly modified bromide excess conditions not exceeding pBr 1.1, have large diameters, often in excess of 2 microns, and are also thin, typically 0.1 microns or less between the major faces, so as to have typical average ratios of diameter/thickness of 20:1 to 30:1. The use of such emulsions in colour negative and x-ray materials is disclosed in U.S. Pat. Nos. 4,433,048, 4,435,449, 4,439,520, and other related patents.

Whilst tabular grains in general can be expected to have advantages of good developability and increased useful adsorption of sensitising dye per weight of silver due to their high surface area-to-volume ratio, those of very high diameter/thickness ratio also have certain disadvantages. One of these is stress marking and associated problems due to their fragility and ease of physical distortion under mechanical strain. The grain size distribution curve of the emulsion tends to have a tail indicating the presence of larger grain sizes, so that a typical emulsion having a mean grain diameter of 1 to 2 microns can contain a significant proportion of grains 4 or more microns in diameter. These, and the thin needles which are usually also present, are more susceptible to physical damage and fog formation. Satisfactory chemical sensitisation and stabilisation are also more difficult with thin tabular grains than with conventional grains, so that post-coating instability can be a serious problem. The silver image developed from thin tabular grains has a very noticeable reddish-brown hue, which is a serious disadvantage for medical x-ray films, in which the hue is displayed prominently in the diagnostically important low-to-middle density regions, and is unacceptable to radiologists.

Thick tabular grains, e.g. having diameter/thickness ratios of below 12:1 can be expected to overcome most of these problems. It is known to make emulsions in which thick tabular grains are present by using a pBr substantially above or below pBr 0.77 or, as is very common in traditional emulsions, by adding silver throughout a range of pBr in this region, starting with a high halide concentration. An example of such an emulsion is disclosed in U.S. Pat. Nos. 4,210,450 and 4,425,426. Also, the presence throughout crystal growth of substantial amounts of non-halide AgX solvents, such as ammonia or various sulphur compounds, results in the presence of thick grains of tabular appearance, as in the traditional "ammoniacal" emulsions. A further method is to commence emulsification with a core addition of iodide, or to use non-tabular seed crystals of silver iodide or iodobromide, as disclosed in U.S. Pat. No. 4,184,878.

These methods do not enable the final thickness of the crystals to be controlled at will during growth, and many are unsatisfactory in respect of giving emulsions having crystals of predominantly very low diameter/-thickness ratios, in some cases with mixtures of crystals of different thicknesses and morphology.

European Patent Application No. 0263508 discloses a process for the preparation of a photographic emulsion containing tabular silver halide grains, which exhibit high speed upon sensitisation, having a thickness of about 0.05 to 0.5 $\mu$m, average grain volume of about 0.05 to 1.0 $\mu m^3$, and a mean aspect ratio of greater than 2:1 comprising:

a) adding silver nitrate to a vessel containing a dispersing medium/bromide mixture wherein the initial bromide ion concentration is 0.08 to 0.25 normal whereby tabular seed grains are formed, b) adding an ammoniacal base solution to achieve 0.002 to 0.2 normal of the base after at least 2% of the total silver nitrate has been added to the vessel, and, c) adding silver nitrate and halide taken from the group consisting of $Br^-$ and $BrI^-$ by balanced double jet procedure whereby tabular grains are formed.

U.S. Pat. No. 4,722,886 discloses a process for the preparation of a photographic emulsion containing tabular silver halide grains having a narrow size distribution comprising:

a) adding silver nitrate to a vessel containing a dispersing medium/bromide mixture wherein the initial bromide ion concentration is 0.08 to 0.25 normal, whereby tabular seed grains are formed, b) adding a basic silver halide solvent solution to achieve 0.02 to 0.2 normal of the solvent after at least 2% by weight of the total silver nitrate has been added to said vessel, c) stopping silver nitrate addition for a time period of 0.5 to 60 minutes to permit the tabular seed grains to ripen wherein the bromide ion concentration is in the range of 0.005 to 0.05 normal, d) neutralizing at least some of the solvent that is present, and, e) adding silver nitrate and halide taken from the group consisting of $Br^-$ and $BrI^-$ by balanced double jet addition whereby the tabular grains of narrow size distribution are formed.

The specific Examples of the latter two processes add the ammoniacal base solution before 10% by weight of the total of silver nitrate has been added. In order to achieve narrow size distribution the ammoniacal base solution is added and the initial silver nitrate addition halted for a time period of from 1 to 60 minutes at a bromide ion concentration in the range 0.005 to 0.05N, thereafter at least some of the ammoniacal base is neutralised.

It has now been found that if a substantial part of grain growth is completed before ammonia is added the thickness of the crystals can be controlled at will, independently of the diameter, and a narrow grain size distribution may be obtained.

SUMMARY OF THE INVENTION

Therefore, according to the present invention there is provided a process for the preparation of a photographic emulsion containing tabular silver halide grains having an aspect ratio in the range from 12:1 to 3:1 and a monomodal narrow size distributor comprising:

(i) preparing a dispersing medium/bromide mixture having a pBr in the range 0.6 to 1.0, (ii) adding to the mixture silver nitrate and further halide as necessary to maintain an excess of bromide whereby tabular grains are formed, (iii) adding ammoniacal base solution to the mixture to achieve at least 0.05N of the base after at least 20% by weight of the total silver nitrate has been added, (iv) adding further silver nitrate and halide by balanced double jet procedure whilst maintaining a concentration of ammoniacal base of at least 0.03N, whereby thickened tabular grains are formed.

The process of the invention provides an emulsion comprising silver halide grains of tabular shape and having a ratio of diameter to thickness lying in the range 3:1 to 12:1. The means by which this is accomplished is to grow silver halide grains under conditions of bromide excess optimal for edge growth in the absence of ammonia and largely in the absence of other non-halide physical ripening agents. This initial growth step may comprise the total growth in diameter of the tabular crystals and is followed by a subsequent growth step at higher pBr in the presence of ammonia. Growth in this later stage, in which there is little or no increase in the diameter of the tabular crystals, is prolonged until the crystals have reached the required thickness and hence the required aspect ratio. The resulting crystals have monomodal narrow grain size distribution and may be utilised in a wide range of photographic elements with appropriate sensitisation including x-ray films, graphic arts films, colour photographic films etc.

DESCRIPTION OF PREFERRED EMBODIMENTS

Figure 1:
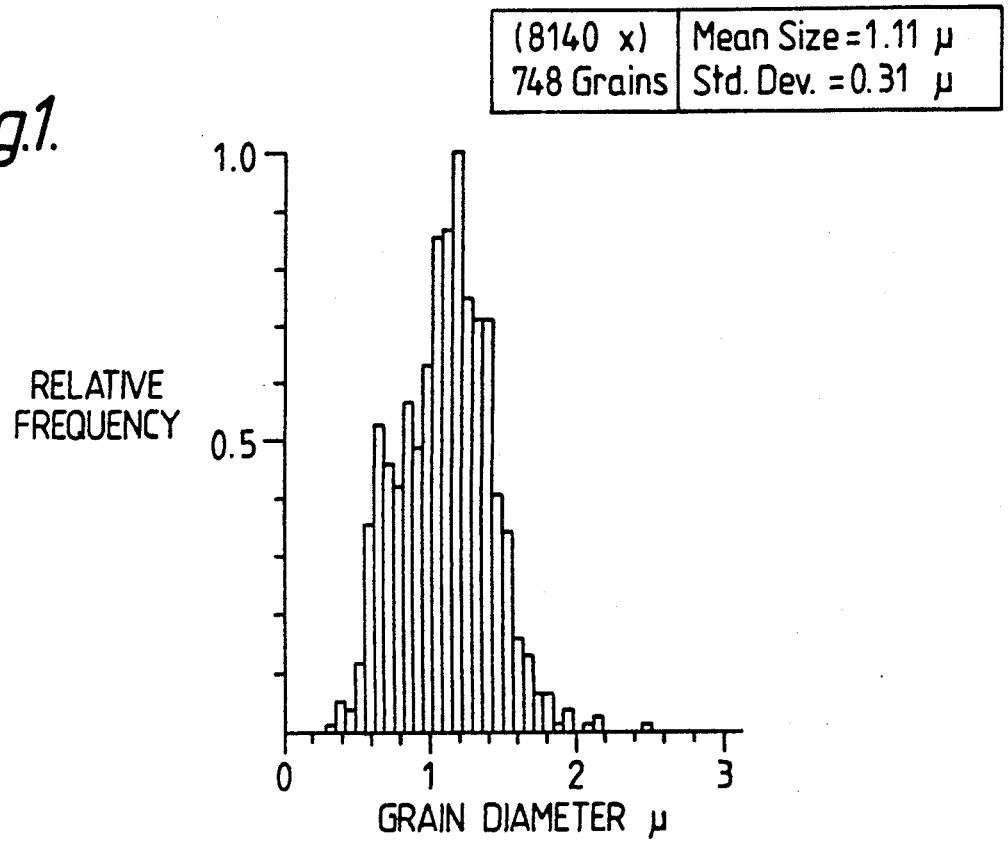

The initial growth stage of the crystals is preferably conducted so that at least 25%, more preferably at least 30% and often more than 50% by weight of the total silver nitrate is added prior to the addition of ammoniacal base. The aspect ratio of the tabular crystals in the initial growth stage will be higher than that required of the final crystals and will generally be at least 4:1. In the initial growth stage at least a portion of the silver nitrate may be added by balanced double jet addition with halide. Preferably at least 9%, more preferably at least 30% of the total silver nitrate is added in step (ii) with halide by balanced double jet procedure. Generally, at least 10%, preferably at least 14.5%, more preferably at least 35% of the total silver nitrate is added before the pBr of the mixture exceeds 1.0.

The addition of ammoniacal base is preferably in an amount to achieve a concentration of at least 0.10N of the base. There appears to be no advantage in stopping silver nitrate addition for a prolonged period nor in neutralising at least a portion of the base. Accordingly, the concentration of ammoniacal base is preferably maintained at a concentration of at least 0.05N during the later growth stage of the crystals. In practice, the concentration of ammoniacal base simply falls with the dilution effect of the silver nitrate and halide added during the late growth stage. The feedstock for the growth of the emulsions can advantageously include halides other than bromide, e.g. a mixture of iodide and bromide salts can be used, in which the ratio of iodide to bromide can either be the same, or continuously or discontinuously varied throughout precipitation. Up to 12% by weight of the total halide may comprise iodide without deleterious effect on crystal growth.

The particle diameter of the crystals may be predetermined by the selection of conditions for crystal growth. Emulsions suitable for x-ray films preferably comprise pure silver bromide of grain size in the range 1.0 to 1.4, preferably 1.2 to 1.3 microns, having an aspect ratio of from 7:1 to 8:1.

The invention will now be illustrated by the following Examples.

The spectral sensitising dyes used in the Examples were of the following structure:

I

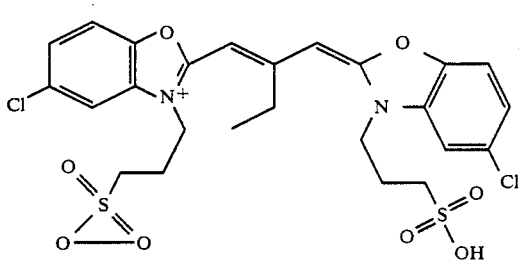

II

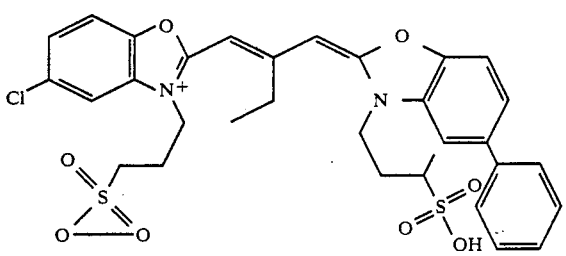

III

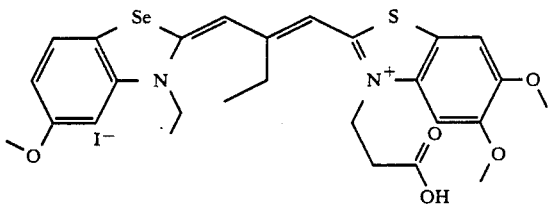

IV

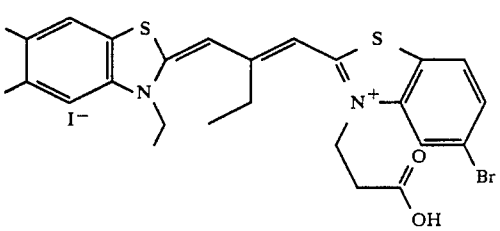

Figure 2:
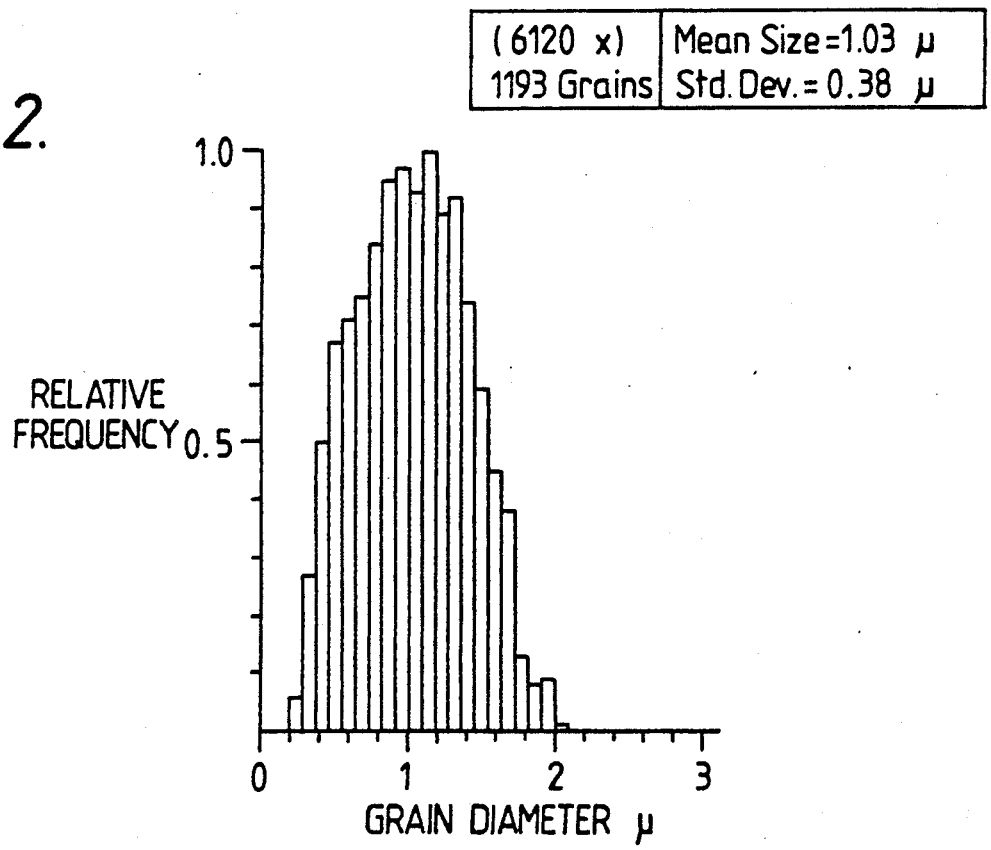

FIGS. 1 and 2 of the accompanying drawings represent plots of grain diameter against relative frequency for the emulsions of Examples 6 and 12 respectively.

References in the Examples to using a certain number of moles of silver mean that a sufficient volume of the silver containing solution was added to the reaction mixture so as to provide that amount of silver for reaction.

EXAMPLE 1

Growth of AgBrI (overall 1% AgI) thick tabular grains having an AgBr nucleus (1.6 Ag%). covered by a 2% AgI core region (21 Ag%) surrounded by successive zones having 1% and 0% AgI, respectively containing 67.9% and 9.4% of the total silver.

To 1.88 liters of 1.3% aqueous inert bone gelatine at 55° C., containing KBr to give an initial pBr of 0.94, was added a 1.0M solution of $AgNO_3$ at a constant rate during 8 minutes, using 0.051 moles of Ag. Simultaneously, a 1.33M solution of KBr was added at a rate sufficient to maintain pBr 0.94. A 1.11M solution of $AgNO_3$ was then added during 20 minutes at an increasing rate (4.07×faster at finish), using 0.40 moles of Ag. A 1.19M solution of KBr, also 0.025M in KI, was simultaneously added at a similarly accelerated rate sufficient to maintain pBr 0.94. A 1.10M solution of $AgNO_3$ which was also 0.013M in dissolved AgI was then added at a constant rate for 32.7 minutes, using 0.257 moles of silver, causing the pBr to rise to 1.78. Further inert bone gelatine was then added to give a total concentration of 3.3%, and the temperature reduced to 50° C. A 2.02M solution of silver nitrate which was also 0.021M in dissolved AgI was then added during 2.7 minutes, using 0.027 moles of silver. A 12M solution of ammonia was added to make the emulsion 0.1M in $NH_3$, and addition of the 2.02M $AgNO_3$ solution containing 0.021M AgI was continued at a constant rate during 53.6 minutes, using 2.18 moles of Ag. Simultaneously a 2.08M solution of KBr was added to maintain constant pBr 2.24. A 2.00M solution of silver nitrate was then added at a constant rate during 7.5 minutes, adding 0.3 moles of Ag, whilst continuing to maintain pBr 2.24 by simultaneous addition of 2.08M KBr. The ammonia (final concentration 0.057M) was neutralised to pH 6 by addition of $H_2SO_4$, and the emulsion washed by coagulation.

The silver halide grains were examined by transmission electron microscopy (TEM) of a carbon replica shadowed at an angle of 45°, and were found to comprise thick platelets in the form of hexagons or truncated triangles. The mean equivalent circle diameter was 1.44 microns, and the mean thickness 0.2 microns, giving a diameter to thickness ratio of 7.2:1.

EXAMPLE 2

Growth of AgBrI (overall 1.4% AgI) thick tabular grains having an AgBr nucleus (1.6 Ag%) covered by a 12% AgI core region (12.4 Ag %) surrounded by an AgBr shell (86 Ag%).

To 1.97 liters of 1.3% aqueous inert bone gelatine at 50° C., containing KBr to give an initial pBr of 0.93, was added to 1.0M solution of $AgNO_3$ at a constant rate during 8 minutes, using 0.055 moles of Ag. Simultaneously, a 1.36M solution of KBr was added at a rate sufficient to maintain pBr 0.93. A 1.09M solution of $AgNO_3$ was then added during 20 minutes at an increasing rate (4.0×faster at finish), using 0.407 moles of Ag. A 1.16M solution of KBr, also 0.125M in KI, was simultaneously added at a similarly accelerated rate sufficient to maintain pBr 0.93. A 1.09M solution of $AgNO_3$ was then added at a constant rate for 29 minutes, using 0.314 moles of silver, causing the pBr to rise to 2.24. Further inert bone gelatine was then added to give a total concentration of 3.3%, and a 12M solution of ammonia was added to make the emulsion of 0.1M in $NH_3$. A 2.0M $AgNO_3$ solution was added at a constant rate during 60 minutes, using 2.4 moles of Ag. Simultaneously a 2.08M solution of KBr was added to maintain constant pBr 2.24. The ammonia (final concentration 0.057M) was neutralised to below pH 6 by addition of $H_2SO_4$, and the emulsion washed by coagulation.

The silver halide grains were examined by TEM of a carbon replica shadowed at an angle of 45°, and were found to comprise thick platelets in the form of hexagons or truncated triangles. The mean equivalent circle diameter was 1.44 microns, and the mean thickness 0.17 microns, giving a diameter to thickness ratio of 8.5:1.

EXAMPLE 3

Growth of AgBrI (overall 1.7% AgI) thick tabular grains having an AgIBr nucleus 12% AgI) (16 Ag %) surrounded by an AgBr shell (84 Ag%).

To 2.05 liters of 2.6% aqueous inert 75% phthalated bone gelatine at 50° C., containing KBr to give an initial pBr of 0.89, was added a 1.09M solution of $AgNO_3$ at a constant rate during 8 minutes, using 0.113 moles of Ag. Simultaneously, a 1.18M solution of KBr, also 0.113M in KI was added at a rate sufficient to maintain pBr 0.89. A 1.09M solution of $AgNO_3$ was then added during 20 minutes at an increasing rate (2.6×faster at finish), using 0.436 moles of Ag. A 1.189M solution of KBr, also 0.113M in KI, was simultaneously added at a the same rate. A 1.09M solution of $AgNO_3$ was then added at a decreasing rate (2.5×slower at finish) during 15 minutes, and then for 7 min at the final rate, using 0.367 moles Ag, causing the pBr to rise to 2.3. Further inert 75% phthalated bone gelatine was then added to give a total concentration of 3.1%, and a 12M solution of ammonia was added to make the emulsion 0.12M in $NH_3$. A 2.0M $AgNO_3$ solution was added at a constant rate during 60 minutes, using 2.5 moles of Ag. Simultaneously a 2.08M solution of KBr was added to maintain constant pBr 2.3. The ammonia (final concentration 0.07M) was neutralised by addition of $H_2SO_4$, and the emulsion washed by coagulation.

EXAMPLE 4

Growth of AgBrI (overall 1% AgI) thick tabular grains having an AgBr nucleus (3.1 Ag%), covered by a 2% AgI core region (12 Ag%) surrounded by a shell containing 1% AgI, illustrating the use of higher final ammonia concentrations to obtain thicker grains.

To 1.85 liters of 1.3% aqueous inert bone gelatine at 50° C., containing KBr to give an initial pBr of 0.94, was added a 1.0M solution of $AgNO_3$ at a constant rate during 8 minutes, using 0.101 moles of Ag. Simultaneously, a 1.33M solution of KBr was added at a rate sufficient to maintain pBr 0.94. A 1.11M solution of $AgNO_3$ was then added during 20 minutes at an increasing rate (4.0×faster at finish), using 0.40 moles of Ag. A 1.19M solution of KBr, also 0.033M in KI, was simultaneously added at a similarly accelerated rate sufficient to maintain pBr 0.94. The 1.11M solution of $AgNO_3$ was then added at a constant rate for 4.3 minutes, using 0.112 moles of silver, then at a constant rate for 10.9 minutes, using 0.142 moles of silver, and then at a constant rate for 5.9 minutes, using 0.03 moles of silver, the total of these additions causing the pBr to rise to 2.24. Further inert bone gelatine was then added to give a total concentration of 3.3%, and a 12M solution of ammonia was added to make the emulsion 0.2M in $NH_3$. A 2.0M $AgNO_3$ solution was added at a constant rate during 60 minutes, using 2.4 moles of Ag. Simultaneously, a 2.12M solution of KBr which was also 0.021M in KI was added to maintain constant pBr 2.24. The ammonia (final concentration 0.112M) was neutralised to below pH 6 by addition of $H_2SO_4$, and the emulsion washed by coagulation.

The silver halide grains were examined by transmission electron microscopy (TEM) of a carbon replica shadowed at an angle of 45°, and were found to comprise thick platelets in the form of hexagons or truncated triangles. The mean equivalent circle diameter was 1.55 microns, and the mean thickness 0.30 microns, giving a diameter to thickness ratio of 5.2:1.

EXAMPLE 5

AgBr Thick Tabular Grains showing improved uniformity due to precipitation at high initial dilution.

To 3.46 liters of 1.1% aqueous inert bone gelatine at 57° C., containing KBr to give an initial pBr of 0.73, and containing a 4.3 millimolar concentration of sodium thiocyanate, was added a 2.0M solution of $AgNO_3$ at a constant rate during 8 minutes, using 0.096 moles of Ag, causing the pBr to rise to 0.80. The 2M $AgNO_3$ solution was then added at an increasing rate (6.8×from start to finish) during 19.5 minutes, using 0.92 moles Ag. A 2.02M solution of KBr was simultaneously added at the same rate, so that the pBr rose to 0.89 by the end of the addition. The 2.0M solution of $AgNO_3$ was then added at a constant rate for 25.5 minutes, using 0.509 moles of silver, causing the pBr to rise to 1.9. A 12M solution of ammonia was added to make the emulsion 0.16M in $NH_3$. A 2.0M $AgNO_3$ solution was added at a constant rate during 30 minutes, using 1.0 moles of Ag. Simultaneously a 2.02M solution of KBr was added to maintain constant pBr 1.9. The ammonia (final concentration 0.13M) was neutralised to below pH 6 by addition of $H_2SO_4$, and the emulsion washed by coagulation. The silver halide grains were examined by transmission electron microscopy (TEM) of a carbon replica shadowed at an angle of 18°, and were found to comprise thick platelets in the form of somewhat rounded hexagons or truncated triangles. Thick tabular grains of more than 0.6 microns in diameter and less than 0.3 microns in thickness accounted for 97% of the total projected area. These had a mean equivalent circle diameter of 1.41 microns, and a mean thickness 0.164 microns, giving a diameter to thickness ratio of 8.6:1.

EXAMPLE 6

AgBr Thick Tabular Grains grown under conditions to minimise diameter and give maximum uniformity.

To 3.46 liters of 0.87% aqueous inert bone gelatine at 55° C., containing KBr to give an initial pBr of 0.82, and containing a 4.3 millimolar concentration of sodium thiocyanate, was added a 2.0M solution of $AgNO_3$ at a constant rate during 8 minutes, using 0.096 moles of Ag, causing the pBr to rise to 0.92. The 2M $AgNO_3$ solution was then added at an increasing rate (6.8×from start to finish) during 19.5 minutes, using 0.92 moles of Ag. A 2.02M solution of KBr was simultaneously added at the same rate, so that the pBr rose to 1.01 by the end of the addition. The 2.0M solution of $AgNO_3$ was then added at a constant rate for 3.36 minutes, using 0.269 moles of Ag, causing the pBr to rise to 1.44, and then at a constant rate for 6.2 minutes, using g0.123 moles of Ag, causing the pBr to rise to 2.05. A 12M solution of ammonia was added to make the emulsion 0.13M in $NH_3$. A 2.0M $AgNO_3$ solution was added at a constant rate during 30 minutes, using 1.0 moles of Ag. Simultaneously a 2.02M solution of KBr was added to maintain constant pBr 2.05. The ammonia (final concentration 0.11M) was neutralised to below pH 6 by addition of $H_2SO_4$, and the emulsion washed by coagulation. The silver halide grains were examined by scanning electron microscopy (SEM) and were found to comprise thick platelets in the form of slightly rounded hexagons or truncated triangles. Isometric grains were seen to be present only in very low amounts. The mean equivalent circle diameter of all the grains was 1.11 microns, with a standard deviation of 0.31 microns. The size distribution is shown in FIG. 1. By using SEM views tilted to show the edges of the grains directly, the mean thickness was assessed as being 0.25 microns, giving a mean diameter/thickness ratio of 4.5:1.

EXAMPLE 7

Growth of Thick Tabular Grains having a common AgBr core region (20% total Ag), showing the effect during growth of a shell at pBr 2.4 of altering ammonia concentration (initial 0.12–0.29M), and thiocyanate concentration (initial 0–0.09M) for grains having pure AgBr shells or AgIBr shells up to 5% AgI content.

To 1.37 liters of 2.0% aqueous inert bone gelatine at 50° C., containing KBr to give an initial pBr of 0.74, was added a 2.0M solution of $AgNO_3$ at a constant rate during 8 minutes using 0.073 moles of Ag simultaneously adding a 2.16M solution of KBr at the same rate. The 2.0M solution of $AgNO_3$ was then added during 15 minutes at an increasing rate (4.8×faster at finish), using 0.395 moles of Ag. A 2.16M solution of KBr was added at the same rate as the silver during the final 9 minutes of this addition, so that the pBr rose to 1.0 during the first 6 minutes and then remained constant at this value. Addition of 2.0M $AgNO_3$ was then continued at constant rate for 5 minutes using 0.136 moles of silver, causing the pBr to rise to 1.6, and then at constant rate during 2.7 minutes using 0.037 moles of silver, causing the pBr to rise to 2.4. Further inert bone gelatine was then added to give a total concentration of 2.25%. The remainder of the precipitation was then carried out after adding different quantities of 12M $NH_3$ and of 1M NaSCN, so as to give nine emulsions A–I. The initial ammonia concentration varied in the range 0.11M to 0.29M, and the concentration of thiocyanate in the range 0 to 0.09M: the values are given in Table e1. A 2.0M $AgNO_3$ solution was added at a constant rate during 60 minutes, using 2.5 moles of Ag. Simultaneously a 2.08M solution of KBr was added to maintain constant pBr 2.24. The emulsions A–D were of AgBr throughout, but in the case of emulsions E–I, part of the KBr in the halide solution used for this final precipitation was replaced ro KI, to give overall iodide content in the grains of 4% AgI in emulsions E–K, and 2% AgI in emulsion I. The ammonia, of which the final concentration varied from 0.051M to 0.131M (see Table 1) was neutralised to below pH 6 by addition of $H_2SO_4$, and the emulsion washed by coagulation.

The silver halide grains were examined by SEM, and were found to comprise thick platelets in the form of hexagons or truncated triangles. The mean equivalent circle diameter of each emulsion is reported in Table 1, which also gives the approximate thickness of the grains, assessed from the morphology of the grains see in the SEM pictures. It can bee seen that iodide content and concentration of thiocyanate ripening agent have relatively little effect on grain size and thickness within the ranges used, and that grain thickness is mainly dominated by the concentration of ammonia used, with the higher level of 0.3M $NH_3$ approaching the upper value for production of recognisably tabular grains.

TABLE 1

Preparative details and grain characteristics for emulsions A–I in Example 7, showing % iodide and concentrations of ammonia and thiocyanate during the final 60 minute addition of silver.

| Emulsion | Ammonia Start M | Conc. Finish M | NaSCN Start M | % AgI shell | % AgI over -all | Mean Diameter u | Estimated Diameter/ Thickness Ratio (a) |
|---|---|---|---|---|---|---|---|
| A | 0.12 | 0.05 | 0 | 0 | 0 | 1.15 | 6–10 |
| B | 0.29 | 0.13 | 0 | 0 | 0 | 1.21 | 2–3 |
| C | 0.11 | 0.05 | 0.09 | 0 | 0 | 1.21 | 6–10 |
| D | 0.27 | 0.13 | 0.09 | 0 | 0 | 1.28 | 3–4 |
| E | 0.12 | 0.05 | 0 | 5.2 | 4.1 | 1.19 | 6–10 |
| F | 0.29 | 0.13 | 0 | 5.2 | 4.1 | 1.15 | 2–3 |
| G | 0.11 | 0.05 | 0.09 | 5.2 | 4.1 | | 6–10 |
| H | 0.27 | 0.13 | 0.09 | 5.2 | 4.1 | | 3–4 |
| I | 0.20 | 0.09 | 0.05 | 2.6 | 2.1 | 1.28 | 4–6 |

(a) The thickness of the grains was estimated solely from inspection of simple plan view SEM pictures and the diameter/thickness ratios are therefore approximate.

EXAMPLE 8

Growth of Thick Tabular Grains having a common AgBr core region (22% total Ag), showing the effect during growth of an AgBrI shell (2.6% AgI) at 0.18M initial ammonia concentration of altering pBr in the range 1.6 to 2.4 and altering thiocyanate concentration in the range 0.004 to 0.04M.

To 1.49 liters of 2.0% aqueous inert bone gelatine at 50° C., containing KBr to give an initial pBr of 0.74, was added a 2.0M solution of $AgNO_3$ at a constant rate during 8 minutes, using 0.079 moles of Ag, simultaneously adding a 2.16M solution of KBr at the same rate. The 2.0M solution of $AgNO_3$ was then added during 15 minutes at an increasing rate (4.8×faster at finish), using 0.431 moles of Ag. A 2.16M solution of KBr was added at the same rate as the silver during the final 9 minutes of this addition, so that the pBr rose to 1.0 during the first 6 minutes and then remained constant at this value. Addition of 2.0M $AgNO_3$ was then continued at constant rate for 5 minutes using 0.148 moles of silver, causing the pBr to rise to 1.6, and then at constant rate during 2.7 minutes using 0.041 moles of silver, causing the pBr to rise to 2.4. Further inert bone gelatine was then added to give a total concentration of 2.25%, and 12M ammonia added to give a $NH_3$ concentration of 0.18M. The remainder of the precipitation was then carried out after adding different quantities of 1M NaSCN, and different quantities of KBr to so as to give five emulsions A–E. The initial thiocyanate concentration varied in the range 0.004M to 0.0429M, and the pBr in the range 1.6–2.4 (See Table 2). A 2.0M $AgNO_3$ solution was added at a constant rate during 60 minutes, using 2.5 moles of Ag. Simultaneously a 2.03M solution of KBr, which was also 0.052M in KI was added to maintain pBr constant at the selected value. At the end of precipitation, the ammonia, of which the final concentration was 0.085M, was neutralised to below pH 6 by addition of $H_2SO_4$, and the emulsion washed by coagulation.

TABLE 2

Preparative details and grain characteristics for emulsions A–E in example 8, showing pBr and concentration of thiocyanate during the final 60 minute addition of silver.

| Emulsion | NaSCN Start M | Conc. Finish M | pBr | Mean Diameter u | Standard Deviation of Diameter | Estimated Diameter/ Thickness Ratio (a) |
|---|---|---|---|---|---|---|
| A | 0.004 | 0.002 | 2.4 | 1.11 | 0.29 | 3–5 |
| B | 0.043 | 0.021 | 2.4 | 1.07 | 0.42 | 4–7 |
| C | 0.004 | 0.002 | 1.6 | 1.12 | 0.35 | 4–7 |
| D | 0.043 | 0.021 | 1.6 | 1.01 | 0.40 | 4–7 |
| E | 0.024 | 0.011 | 2.0 | 1.13 | 0.36 | 4–7 |

(a) The thickness of the grains was estimated from inspection of simple plan view SEM pictures and the diameter/thickness ratios are therefore approximate.

The silver halide grains were examined by SEM, and were found to comprise thick platelets in the form of hexagons or truncated triangles. The mean equivalent circle diameter of each emulsion is reported in Table 2, which also gives the approximate thickness of the grains, assessed from the morphology of the grains seen in the SEM pictures. It can be seen that at the common $NH_3$ concentration, initially 0.18M, the variations in pBr and concentration of NaSCN did not have major effects on diameter or thickness of the grains. The main effect of increased NaSCN or bromide excess is to cause some broadening of the grain size distribution.

EXAMPLE 9

Growth of Grains having a common tabular AgBr core region (20% total Ag), showing the use of ammonia at different concentrations promoting thick tabular grain formation by addition of an AgBr shell at pBr 2.4, also showing comparative example in which silver halide solvent was absent.

To 1.26 liters of 1.6% aqueous inert bone gelatine at 55° C., containing KBr to give an initial pBr of 0.85, was added a 1.0M solution of $AgNO_3$ at a constant rate during 8 minutes, using 0.042 moles of Ag, simultaneously adding a 1.25M solution of KBr at the same rate. A 1.11M solution of $AgNO_3$ was then added during 20 minutes at an increasing rate (3.5×faster at finish), using 0.335 moles of Ag. A 1.25M solution of KBr was added at a rate sufficient to maintain the pBr at 0.85. Addition of 1.11M $AgNO_3$ was then continued at constant rate for 10.1 minutes using 0.188 moles of silver, causing the pBr to rise to 1.4, and then at constant rate during 6.6 minutes using 0.080 moles of silver, causing the pBr to rise to 2.45. The remainder of the precipitation was then carried out after adding quantities of $NH_3$, or in the absence of a silver halide solvent, so as to give three emulsions A–C. The initial ammonia concentrations were either around 0.05M or 0.10M: the values are given in Table 3. A 2.0M $AgNO_3$ solution was added at a constant rate during 60 minutes, using 2.0 moles of Ag. Simultaneously a 2.03M solution of KBr was added to maintain constant pBr 2.45. The concentration of the ammonia was approximately halved at the end of this stage. The emulsions were washed by coagulation, during which adjustment to low pH with acid was performed.

TABLE 3

Preparative details and grain characteristics for emulsions A–C in Example 9, showing concentrations of ammonia during the final 60 minute addition of silver.

| Emulsion | Ammonia Start M | Conc. Finish M | Assessment from Optical Photomicrographs |
|---|---|---|---|
| A | 0.11 | 0.06 | Thick tabular grains formed. No evidence of renucleation. |
| B | 0.06 | 0.03 | Thick tabular grains formed. |
| C | 0 | 0 | Mixture of thin tabular grains with numerous small isometric grains (from renucleation). |

The silver halide grains were examined by optical photomicroscopy. The examples A and B illustrating the present invention give rise to the desired thick tabular grains, but in the case of the comparative example C, no shell formation was evident, only thin tabular grains and renucleated cubic grains being present.

EXAMPLE 10

Comparative example showing ineffectiveness of thick tabular grain formation when non-halide silver halide solvent is absent, despite very prolonged continued addition of silver and bromide feedstock at high pBr.

To 1.51 liters of 1.6% aqueous inert bone gelatine at 55° C., containing KBr to give an initial pBr cf 0.85, was added a 1.0M solution of $AgNO_3$ at a constant rate during minutes, using 0.05 moles of Ag, simultaneously adding 1.25M solution of KBr at the same rate. A 1.11M solution of $AgNO_3$ was then added during 20 minutes at an increasing rate (3.5×faster at finish), using 0.40 moles of Ag. A 1.25M solution of KBr was added at a rate sufficient to maintain the pBr at 0.85. Addition of 1.11M $AgNO_{03}$ was then continued at constant rate for 10.1 minutes using 0.223 moles of silver, causing the pBr to rise to 1.4, and then at constant rate during 6.6 minutes using 0.095 moles of silver, causing the pBr to rise to 2.45. A 2M solution of $AgNO_3$ was then added over 300 minutes, using 5.0 moles of silver. A 2.03M solution of KBr was added simultaneously to maintain pBr 2.45. Samples were taken at 60 minute intervals during the final silver addition and examined by SEM. It was seen that thin tabular grains were predominant as the silver addition continued. These did not increase in diameter, and were only slightly increased in thickness at the end, giving a final aspect ratio in the region of 10:1. A progressively larger population of small isometric grains was formed concurrently, final diameter approximately 0.3 microns, and at the end of the precipitation these dominated the emulsion.

EXAMPLE 11

Comparative example showing an emulsion of undesirably wide grain size distribution made by 0.25M ammonia ripening after 27.5 % of silver has been added, with subsequent completion of double jet precipitation after neutralisation of this ammonia addition.

To 1.51 liters of 2.0% aqueous inert bone gelatine at 55° C., containing KBr to give an initial pBr of 0.85, was added a 2.0M solution of $AgNO_3$ at a constant 8 minutes, using 0.096 moles of Ag, simultaneously adding a 2.2M solution of KBr at the same rate. A 2.0M solution of $AgNO_3$ was then added during 6.5 minutes at an increasing rate (1.95×faster at finish), using 0.115 moles of Ag, causing the pBr to rise to 1.17. A 2.0M solution of $AgNO_3$ was then added during 13.minutes at an increasing rate (3.4×faster at finish), using 0.698 moles of Ag, whilst a 2.2M solution of KBr was added at the same rate. A 12M solution of ammonia was added so as to make the emulsion 0.25M in $NH_3$, whilst having a pBr of 1.12. The emulsion was ripened under continued stirring in these conditions for 10 minutes, whereupon 5M $H_2SO_4$ was added until the pH was 5.5, thereby neutralising the $NH_3$ addition. A 2.0M solution of $AgNO_3$ was then added during 20 minutes at an increasing rate (1.5×faster at finish), using 2.4 moles Ag, simultaneously adding 2.2M KBr at the same rate. Finally, a further addition of 0.30 moles Ag was made in 15 minutes, causing the pBr to rise to 1.6, and the emulsion was then coagulation washed.

The silver halide grains were examined by SEM, and were found to have a wide grain size distribution, with a mean of 1.25 microns, and a standard deviation of 0.74 microns. The mode of the distribution was below 0.5 microns, with a long tail containing grains of up to almost 4 microns in diameter. Emulsions prepared in this manner thus do not have the advantageous properties of narrow size distribution exhibited by those of the present invention.

EXAMPLE 12

AgBr Thick Tabular Grains grown under conditions to give maximum uniformity, at a higher aspect ratio than Example 6.

To 3.11 liters of 0.87% aqueous inert bone gelatine at 55° C., containing KBr to give an initial pBr of 0.82, and containing a 4.3 millimolar concentration of sodium thiocyanate, was added a 2.0M solution of $AgNO_3$ at a constant rate during 8 minutes, using 0.086 moles of Ag, causing the pBr to rise to 0.92. The 2M $AgNO_3$ solution was then added at an increasing rate (8.7× from start to finish) during 25.5 minutes, using 1.33 moles of Ag. A 2.02M solution of KBr was simultaneously added at the same rate, so that the pBr rose to 1.05 by the end of the addition. The 2.0M solution of $AgNO_3$ was then added at a constant rate for 2 minutes, using 0.145 moles of Ag, causing the pBr to rise to 1.27, and then at a constant rate for 8 minutes, using 0.145 moles of Ag, causing the pBr to rise to 1.64. A 12M solution of ammonia was added to make the emulsion 0.115M in $NH_3$. A 2.0M $AgNO_3$ solution was added at a constant rate during 30 minutes, using 0.59 moles of Ag. Simultaneously a 2.02M solution of KBr was added at a rate sufficient to cause the bromide excess in the kettle to rapidly reach, and then to maintain, pBr 2.0. The ammonia (final concentration 0.10M) was neutralised to below pH 6 by addition of $H_2SO_4$, and the emulsion washed. The silver halide grains were examined by scanning electron microscopy (SEM) and were found to comprise thick platelets in the form of slightly rounded hexagons or truncated triangles. Isometric grains were seen to be present only in very low amounts. The mean equivalent circle diameter of all the grains was 1.08 microns, with a standard deviation of 0.38 microns. Disregarding grains of less than 0.6 microns in diameter, the mean diameter was 1.20 microns. The size distribution is shown in FIG. 2. By using SEM views tilted to show the edges of the grains directly, the mean thickness was assessed as being 0.157 microns, giving a mean ratio of diameter/thickness of 7.6:1

The following Table 4 summarises the growth conditions for Examples 1 to 11.

EXAMPLE 13

Sensitisation and coating of iodobromide thick tabular grains to give a green sensitive double sided x-ray film.

The thick tabular iodobromide emulsion described in Example 3, having a 10% AgI core (16% of growth) surrounded by pure AgBr, was adjusted to pH 6.8 and a pAg of 8.75 at 40° C. Spectral sensitizing dye (I) was added at a loading of 750 mg , and chemical sensitizers comprising sodium thiosulphate (0.055 mmoles) and gold thiocyanate complex (0.037 mmoles) were added for each mole of silver, and the emulsion digested at 40° C. for 40 minutes, when 5-methyl-7-hydroxy-triazaindclizine (6.9 mmoles) was added.

The emulsion, containing "Hostapur" wetting agent and other usual coating additives was coated equally on either side of a blue polyester film base, to give a total silver coverage of 4.6 g/m$^2$. An inert gelatine protective supercoat containing 1.5 g gelatine/m$^2$ was applied. (Coating A).

The coatings were evaluated in comparison with a double sided coating of a cubic iodobromide emulsion, optimally sensitised for detection of green light (3M×D film). Table 4 shows the results from x-ray exposures using green-emitting 3M Trimax T6 screens, made at 80kV, 25 mA x-ray power for 0.1 sec, and comparative results using 0.1 second exposures to white light through broad band green and blue filters. It can be seen that the thick tabular example coating entirely matches the cubic comparison for sensitivity to the narrow line emission of the intensifying screen at 545 nm, but is less sensitive to broad band green light, and to blue light is 0.4 logE less sensitive than the comparison. These results indicate that spectral rather than chemical sensitisation accounts for a greater proportion of the sensitivity of the example emulsion, showing that it enjoys the same benefits as thin tabular emulsions in this respect. The particularly large difference between broad band green sensitivity and T6 screen sensitivity indicates a very efficient J-band in the example emulsion.

| Emulsion Example | Nucleation pBr | % total Ag Before $NH_3$ | % Ag below or at pBr 1.0 | $NH_3$ at start final growth | $NH_3$ at end final growth | pBr during final growth |
|---|---|---|---|---|---|---|
| 1 | 0.94 | 22.7 | 14.9 | 0.10 | 0.06 | 2.24 |
| 2 | 0.93 | 23.8 | 15.5 | 0.10 | 0.06 | 2.24 |
| 3 | 0.89 | 26.8 | 18.2 | 0.12 | 0.07 | 2.30 |
| 4 | 0.94 | 23.7 | 16.1 | 0.20 | 0.11 | 2.24 |
| 5 | 0.73 | 60.3 | 45.1 | 0.16 | 0.13 | 1.9 |
| 6 | 0.82 | 58.3 | 42.1 | 0.13 | 0.11 | 2.1 |
| 7A | 0.74 | 20.3 | 14.8 | 0.12 | 0.05 | 2.4 |
| 7B | 0.74 | 20.3 | 14.8 | 0.29 | 0.13 | 2.4 |
| 7C | 0.74 | 20.3 | 14.8 | 0.11 | 0.05 | 2.4 |
| 7D | 0.74 | 20.3 | 14.8 | 0.27 | 0.13 | 2.4 |
| 7E | 0.74 | 20.3 | 14.8 | 0.12 | 0.05 | 2.4 |
| 7F | 0.74 | 20.3 | 14.8 | 0.29 | 0.13 | 2.4 |
| 7G | 0.74 | 20.3 | 14.8 | 0.11 | 0.05 | 2.4 |
| 7H | 0.74 | 20.3 | 14.8 | 0.27 | 0.13 | 2.4 |
| 7I | 0.74 | 20.3 | 14.8 | 0.2 | 0.09 | 2.4 |
| 8A | 0.74 | 21.7 | 15.8 | 0.19 | 0.09 | 2.4 |
| 8B | 0.74 | 21.7 | 15.8 | 0.19 | 0.09 | 2.4 |
| 8C | 0.74 | 21.7 | 15.8 | 0.19 | 0.09 | 1.6 |
| 8D | 0.74 | 21.7 | 15.8 | 0.19 | 0.09 | 1.6 |
| 8E | 0.74 | 21.7 | 15.8 | 0.19 | 0.09 | 2 |
| 9A | 0.85 | 21.1 | 14.8 | 0.11 | 0.06 | 2.4 |
| 9B | 0.85 | 21.1 | 14.8 | 0.06 | 0.03 | 2.4 |
| 9C | 0.85 | 100 | 14.8 | 0 | 0 | 2.4 |
| 10 | 0.85 | 100 | 6 | 0 | 0 | 2.45 |
| 11 | 0.85 | 27.5 | 3.8 | 0 | 0 | 1.1 |
| 12 | 0.82 | 74.1 | 37.7 | 0.12 | 0.09 | 2.05 |

TABLE 5

Sensitometric comparisons between green sensitised coatings of thick tabular grains (Example 12) and a conventional cubic green-sensitized x-ray film.

| | X-ray Green screen | | Green broad band filtered light | | | Blue broad-band filtered light | |
|---|---|---|---|---|---|---|---|
| Coating | Speed* | Contrast** | DMIN | Speed* | Contrast** | Speed* | Contrast** |
| Thick tabular (Example) | 1.60 | 1.84 | 0.26 | 1.62 | 2.71 | 0.83 | 2.84 |
| Cubic (Comparison) | 1.61 | 1.82 | 0.22 | 1.93 | 2.63 | 1.25 | 2.75 |

*"Speed" is relative logarithmic sensitivity at developed image O.D. = 1.0.
**Contrast measured between densities of 0.25 and 2.0.

EXAMPLE 14

Sensitization and coating of bromide thick tabular grains to give a green sensitive double sided x-ray film The thick tabular silver bromide emulsion described in Example 12 was chemically and spectrally sensitized as described in Example 13. The emulsion, containing a wetting agent and other usual coating additives was coated equally on either side of a blue polyester film base, to give a total silver coverage of 4.12 g/m$^2$. An inert gelatine protective supercoat containing 1.5 g gelatine/m$^2$ was applied. (Coating B).

A light-sensitive cubic grain silver bromo-iodide gelatine emulsion (having 2.3% mole iodide) was prepared. Said emulsion comprised cubic grains having an average diameter of about 0.7 μm and an average aspect ratio of about 1:1. The emulsion was chemically sensitized with sodium thiosulphate and gold thiocyanate complex, spectrally sensitized with 750 mg of dye (I) and 400 mg of KI per mole of silver and stabilized. The emulsion, containing a wetting agent and other usual coating additives was coated equally on either side of a blue polyester film base, to give a total silver coverage of 4.35 g/m$^2$. An inert gelatine protective supercoat containing 1.5 g gelatine/m$^2$ was applied. (Coating C).

Each coating was interposed between two green emitting 3M Trimax T8 intensifying screens, then exposed through a laminated aluminum step wedge to x-rays of 300 mA and 80 kV for 0.15 seconds. After the exposure, the coatings were processed in a 3M XP 507 roller transport processor. Processing consisted of 3M XDA/2 Developer for 24 seconds at 35° C., followed by fixing in 3M XAF/2 Fixer for 24 seconds at 30° C., washing in tap water for 22 seconds at 35° C. and drying for 22 seconds at 35° C.

The sensitometric and image quality results are reported in the following Table 6. Percent cross-over has been calculated by using the following equation:

$$\text{Percent Cross-over} = \frac{1}{\text{antilog}\ (\delta\log E)} \times 100$$

wherein δlog E is the difference in sensitivity between the two emulsion layers of the same coating when exposed with a single screen (the lower the percent of cross-over, the better the image quality).

TABLE 6

Sensitometric and image quality comparisons between green sensitized coatings of thick tabular grains and green sensitized coatings of cubic grains.

| Coating | Fog | Dmax | Contrast | Speed | % Cross-over |
|---|---|---|---|---|---|
| B | .22 | 4.24 | 2.10 | 2.61 | 23 |

TABLE 6-continued

Sensitometric and image quality comparisons between green sensitized coatings of thick tabular grains and green sensitized coatings of cubic grains.

| Coating | Fog | Dmax | Contrast | Speed | % Cross-over |
|---|---|---|---|---|---|
| C | .21 | 3.16 | 2.42 | 2.66 | 37 |

EXAMPLE 15

Sensitisation and coating of iodobromide thick tabular grains of 2% AgI content to give a red sensitive colour negative fast semilayer forming a cyan image.

The thick tabular iodobromide emulsion described in Example 8B, having a 2.6% iodide outer shell (78% of total Ag) over a pure AgBr core, and grown under conditions of high NaSCN excess, was adjusted to pH 5.5 and a pAg of 8.4 at 40° C. Spectral sensitising dyes III (0.075 g) and IV (0.3 g) were added and allowed to absorb onto the grains for 30 minutes at 40° C. The emulsion was optimally sulphur and gold sensitised, and a triazaindolizine stabiliser was added.

Cyan image forming couplers (35 g/mole) as well as wetting agent and hardener were added and the emulsion was coated on a polyester film base, as was a reference emulsion having conventional octahedral grains: an emulsion used for the highest sensitivity partial cyan layer of 400 ASA tripack. The silver coverage of the example coating was 0.78 g/m$_2$, giving the dye image DMAX of 1.83, and that of the reference was 0.88 g/m$_2$, giving DMAX of 1.54, showing a useful increase in covering power for the example emulsion. The relative logarithmic sensitivity (measured at developed dye density of 0.2 above fog) of the example was 2.51, with DMIN of 0.26, compared with a sensitivity of 2.75 for the reference.

I claim:

1. A process for the preparation of a photographic emulsion containing tabular silver halide grains having an aspect ratio in the range from 12:1 to 3:1 and a monomodal narrow size distribution, the process comprising:

(i) preparing a dispersing medium/bromide mixture having a pBr in the range 0.7 to 1.0, (ii) adding to said mixture of step (i) silver nitrate and further halide as necessary to maintain an excess of bromide whereby tabular seed grains of silver bromide are formed, at least a portion of said silver nitrate being added with said halide by a balanced double jet procedure, (iii) adding ammoniacal base solution to said mixture step (ii) to achieve at least 0.05N of the base after at least 20% by weight of the total silver nitrate has been added, (iv) adding further silver nitrate and halide by balanced double jet procedure whilst maintaining a concentration of ammoniacal base of at least 0.03N, whereby tabular grains of silver halide are formed.

2. A process according to claim 1 wherein said ammoniacal base is added after at least 25% by weight of the total silver nitrate has been added.

3. A process according to claim 1 wherein said ammoniacal base is added after more than 30% by weight of the total silver nitrate has been added.

4. A process according to claim 1 wherein at least 10% by weight of the total silver nitrate is added before the pBr of the mixture exceeds 1.0.

5. A process according to claim 1 wherein at least 14.5% by weight of the total silver nitrate is added before the pBr of the mixture exceeds 1.0.

6. A process according to claim 1 wherein said ammoniacal base is added in step (iii) to achieve at least 0.10N of the base.

7. A process according to claim 1 wherein a concentration of ammoniacal base of at least 0.05N is maintained during step (iv).

8. A process according to claim 1 wherein the bromide concentration is adjusted to a pBr of at least 1.5 prior to step (iv).

9. A process according to claim 1 wherein a thiocyanate salt ripening agent is present during step (iv).

10. A process according to claim 1 wherein said dispersing medium comprises gelatine.

* * * * *

UNITED STATES PATENT AND TRADEMARK OFFICE

CERTIFICATE OF CORRECTION

PATENT NO. : 5,028,521

DATED : July 2, 1991

INVENTOR(S) : Nicholas E. Grzeskowiak

It is certified that error appears in the above-identified patent and that said Letters Patent is hereby corrected as shown below: On the title page: Item [54] and column 1, line 3, Title: "Tubular" should read --tabular--;
Abstract, line 16: "while" should read --whilst and (V)should read--(iV) --.
Column 1, line 27: "know" should read --known--;
Column 6, line 32: Delete "a";
Column 8, line 2: "g0.123" should read --0.123--;
Column 8, line 55: "Table el" should read --Table 1--;
Column 8, line 61: "ro" should read --by--;
Column 9, line 4: "see" should read --seen--;
Column 9, line 5: "bee" should read --be--;
Column 11, line 66: "during minutes" should read --during 8 minutes--;
Column 12, lines 31-32: "constant 8 minutes" should read --constant rate during 8 minutes--;
Column 12, line 37: "13." should read --13.5--;
Column 14, lines 13 & 14: "triazaindclizine" should read --triazaindolizine--;
Column 14, line 23: "(3MXD" should read --(3M XD--
Column 16, lines 67 & 68: "mixture step (ii)" should read --mixture of step (ii)--;
Column 18, line 16: "gelatine" should read --gelatin--.

Signed and Sealed this

Sixteenth Day of November, 1993

*Attest:*

*Attesting Officer*

BRUCE LEHMAN

*Commissioner of Patents and Trademarks*